United States Patent [19]

Sakabe

[11] 4,356,346

[45] Oct. 26, 1982

[54] TRANSMISSION CONDUCTOR

[75] Inventor: Sadao Sakabe, Kyoto, Japan

[73] Assignee: Kansai Electric Power, Ltd., Osaka, Japan

[21] Appl. No.: 206,132

[22] Filed: Nov. 12, 1980

[30] Foreign Application Priority Data

Nov. 13, 1979 [JP] Japan ..... 54-147478
Sep. 17. 1980 [JP] Japan ..... 55-129605

[51] Int. Cl.[3] ..... H01B 5/10
[52] U.S. Cl. ..... 174/130; 174/128 R
[58] Field of Search ..... 174/127, 128 R, 130, 174/131 R, 131 A, 131 B; 57/161, 212

[56] References Cited

U.S. PATENT DOCUMENTS 3,445,586 5/1969 Edwards et al. ..... 174/130
3,760,093 9/1973 Pemberton ..... 174/128 R
3,813,772 6/1974 Adams ..... 174/130 X
3,823,542 7/1974 Pemberton ..... 57/161

FOREIGN PATENT DOCUMENTS 1920744 11/1970 Fed. Rep. of Germany ..... 174/130

*Primary Examiner*—Volodymyr Y. Mayewsky
*Attorney, Agent, or Firm*—Staas & Halsey

[57] ABSTRACT

A transmission conductor comprises an inner conductor or conductors substantially shaped in a cylindrical form, and an outer conductor layer covering the inner conductor or conductors, the outer conductor layer being annular in section, having an even outer surface and being split in a plane or planes radially extending on the center of the transmission conductor into a plurality of split conductor elements. Outer corners of the two adjacent split conductor elements at every predetermined number of junctions between the plurality of split conductor elements are formed in rounded corners, i.e. arcuate in section, with a radius r (m) of curvature. These plurality of split conductor elements disposed annularly on the outer surface of the inner conductor or conductors are stranded in the longitudinal direction. Thus, a plurality of grooves are formed on the outer surface of the outer conductor layer extending in the stranded longitudinal direction between the rounded corners of the two adjacent split conductor elements. The sectional geometry of the grooves is selected to achieve a low wind pressure transmission conductor or a low wind singing transmission conductor. In the case of a low wind pressure conductor, the radius r of curvature is selected to be $$r = \frac{0.0508}{V}\left(10^{\frac{\theta-28.5}{111}} \sim 10^{\frac{\theta+5.2}{113}}\right),$$

where V (m/sec) is a wind velocity, and $\theta$ (degree) is the angle between two adjacent grooves with respect to the center of the transmission conductor. On the other hand, in the case of a low wind singing transmission conductor, the geometry of the grooves is selected to satisfy $10 \cdot r/D + \log\theta > 2.55$, where D(m) is the diameter of the transmission conductor.

4 Claims, 24 Drawing Figures

PRIOR ART

TRANSMISSION CONDUCTOR

BACKGROUND OF THE INVENTION

1. Field of the Invention

The present invention relates to a conductor for an overhead transmission line or a transmission conductor. More specifically, the present invention is directed to a transmission conductor for use in transmission of high voltage electric power.

2. Description of the Prior Art

FIG. 1A is a sectional view of a conventional transmission conductor 10 which comprises a plurality of conductor elements each circular in section bundled and stranded in the form of a cylinder. Some type of conventional transmission conductor 10 has a plurality of conductor elements 12 each circular in section and having a high tensile strength of such as aluminum, copper or the like disposed annularly in a layer on the outer surface of an inner conductor or conductors 11 of steel, while the same are stranded in the longitudinal direction. Such transmission conductor 10 is generally referred to as an ACSR (alminum conductor steel reinforced). Since such an ACSR 10 has an uneven surface, a problem is involved that corona discharge is liable to occur.

FIG. 1B is a sectional view of another conventional transmission conductor 20 which comprises an outer conductor layer 22 covering an inner conductor or conductors 21, the outer conductor layer 22 being annular in section and being split into a plurality of split conductor elements. More specifically, the transmission conductor 20 comprises the inner conductor or conductors 21 substantially shaped in a cylindrical form, and the outer conductor layer 22 covering the inner conductor or conductors, the outer conductor layer being annular in section and being split in a plane or planes radially extending on the center of the transmission conductor into a plurality of split conductor elements. These plurality of split conductor elements disposed annularly on the outer surface of the inner conductor or conductors are stranded in the longitudinal direction. Since the outer conductor layer of the FIG. 1B transmission conductor 20 has an even outer surface, an advantage is brought about that corona discharge is prevented.

When a transmission conductor is subjected to a flow of air or a wind, it must suffer a pressure caused by a wind or an air flow and the value of the above described pressure P is given by the following formula:

$$P \alpha \rho Cx\ V^2$$

where $\rho$: density of air

V: velocity of a wind or an air flow

Cx: surface drag coefficient

Since the air pressure applied to the transmission conductor is different depending on the air flow, it is desired that a surface drag coefficient Cx of the wind receiving surface of the transmission conductor is decreased. The reason will be described in the following with reference FIG. 2.

FIG. 2 is a graph showing a relation between the Reynolds' number R and the drag coefficient Cx of the wind receiving surface for each of different kinds of conventional transmission conductors. Referring to FIG. 2, the abscissa indicates the Reynolds' number R in the logarithmic scale and the ordinate indicates the drag coefficient in an ordinary scale. The solid line curve a and the dotted line b show such relation of transmission conductors having such structure as shown in FIG. 1A. More specifically, the curve a shows such relation of a transmission conductor which is 116 mm in diameter comprising an outer conductor layer of thirty conductor elements each being circular in section and 10.6 mm in diameter, as stranded, whereas the curve b shows such relation of a transmission conductor which is 116 mm in diameter comprising an outer conductor layer of 36 conductor elements each being circular in section and 8.9 mm in diameter, as stranded. On the other hand, the solid line curve c shows a relation of a transmission conductor of the same diameter as that of the curves a and b and having a cylindrical and even outer surface.

As well known, the maximum wind pressure P(Kg/m$^2$) per minute are of the transmission conductor may be expressed by the following equation (1):

$$P = \tfrac{1}{2}\rho Cx\ V^2 \qquad (1)$$

where $\rho$ (Kg sec$^2$/m$^4$) is the density of the air, Cx (no dimension) is a drag coefficient of the wind receiving surface, and V(m/sec) is a wind velocity.

The drag coefficient Cx is determined by the Reynolds' number R. The Reynolds' number R is determined by the following equation (2):

$$R = VD/\nu \qquad (2)$$

where D(m) is the diameter of the transmission conductor, and $\nu$ is an air Rinematic viscosity coefficient, wherein in standard condition, i.e. the condition of one atomospheric pressure at 15° C. in designing a transmission conductor, $\nu$ is constant and is $1.456\times10^{-5}$ m$^2$/sec.

Meanwhile, as shown by the curves a and b in FIG. 1, in the case of a stranded wire, the drag coefficient Cx is large when the Reynolds' number R is small, say $2\times10^4$, and the drag coefficient Cx becomes minimum when the Reynolds' number R is $4\times10^4$ to $6\times10^4$, whereas a change of the drag coefficient Cx becomes small when the Reynolds' number R exceeds $6\times10^4$. On the other hand, in the case of a transmission conductor covered with a pipe or a transmission conductor of a cylindrical form as in the case of the curve c in FIG. 2, the drag coefficient Cx is larger in the region where the Reynolds' number R is small and, as the Reynolds' number R becomes larger, the drag coefficient Cx abruptly decreases. Meanwhile, since the FIG. 1B transmission conductor 20 has an even outer surface, a relation between the Reynolds' number R and the drag coefficient Cx becomes such a characteristic as shown by the curve c as in the case of a pipe. Therefore, ideally a transmission conductor of the minimum drag coefficient Cx should be attained by selecting the outer form of the transmission conductor to be a cylindrical form. However, in order to select the Reynolds' number R so as to minimize the drag coefficient Cx, it becomes necessary to select the diameter of the transmission conductor to be so undesirably large in an ordinary wind velocity range that it should be difficult to implement the conductor.

On the other hand, it is well known that when the transmission conductor 10, as stranded, as shown in FIG. 1A is subjected to a wind of the wind velocity of 10 m/sec or more a von Kärmän vortex stream is caused behind the transmission conductor and a wind singing called an aeolian tone similar to a beat is generated. Such wind singing causes an uncomfortable feeling to the people living in the vicinity of the transmission conductor, as installed, it is necessary to reduce the same.

FIG. 3 is a graph showing the characteristic obtained by measuring the sound noise generated by a conventional transmission conductor 10 in terms of a sound pressure level (dB) with respect to each of the frequency regions (Hz). The FIG. 3 graph shows the measurements of the sound pressure levels by ten second evaluation for each frequency bandwidth of $\frac{1}{3}$ octave width, i.e. a one-third of the one octave width A from the frequency bandwidth having the maximum sound pressure level. The larger the sound pressure level, the larger the wind singing. Thus, it would be appreciated that a sound pressure level of a conventional transmission conductor was considerably high. In particular, it would be appreciated that the wind singing in the frequency region of the maximum sound pressure level becomes a very offensive noise.

SUMMARY OF THE INVENTION

In summary, the present invention comprises a transmission conductor comprising an inner conductor substantially shaped in a cylindrical form, and an outer conductor layer covering the inner conductor, the outer conductor layer being annular in section, and being split in a plane or planes radially extending on the center of the transmission conductor into a plurality of split conductor elements, corners of the adjacent split conductor elements at every predetermined number of junctions between the plurality of split conductor elements being formed in rounded corners, arcuate in section, whereby a plurality of grooves are formed on the outer surface of the outer conductor layer extending in the longitudinal direction between the rounded corners of the two adjacent split conductor elements. The sectional geometry of the grooves is selected to achieve a low wind pressure transmission conductor or a low wind singing transmission conductor.

In a preferred embodiment of the present invention, the radius r (m) of curvature of the rounded corners, arcuate in section, of the two adjacent split conductor elements is selected to be $$r = \frac{0.0508}{V}\left(10^{\frac{\theta-28.5}{113}} \sim 10^{\frac{\theta+0.52}{113}}\right),$$

where V (m/sec) is a wind velocity, and $\theta$ (degree) is the angle between two adjacent grooves with respect to the center of the transmission conductor. As a result, a low wind pressure transmission conductor is provided through proper selection of the radius r (m) of curvature of the rounded corners and as a result an installation cost of the transmission conductor can be decreased. Furthermore, the height of iron towers for the inventive transmission conductor can be decreased due to a decreased hanging amount and hence visual harmonization with the environment can be achieved.

In another preferred embodiment of the present invention, the geometry of the grooves is selected to satisfy $10 \cdot r/D + \log \theta > 2.55$, where r (m) is the radius of curvature of the rounded corners, D (m) is the diameter of the transmission conductor and $\theta$ (degree) is the angle between two adjacent grooves with respect to the center of the transmission conductor. As a result, a low wind singing transmission conductor is provided and a problem of the wind singing of the transmission conductor is eliminated.

In a further preferred embodiment of the present invention, the size of the two adjacent split conductor elements connecting to the outer rounded corners are left in the junction surfaces extending in the radial direction of the transmission conductor, so that the two adjacent split conductor elements are in face contact. As a result, even if the height or thickness of the split conductor elements cannot be large enough, stranding of the split conductor elements of the outer conductor layer can be achieved with ease, whereby fabrication of the inventive transmission conductor is facilitated.

Accordingly, a principal object of the present invention is to provide an improved transmission conductor.

Another object of the present invention is to provide a transmission conductor a wind pressure of which is reduced.

A further object of the present invention is to provide a transmission conductor a wind singing of which is reduced.

Still a further object of the present invention is to provide a transmission conductor of a reduced wind pressure or a reduced wind singing, wherein split conductor elements of an outer conductor layer can be stranded with ease, thereby to facilitate fabrication thereof.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 4A:
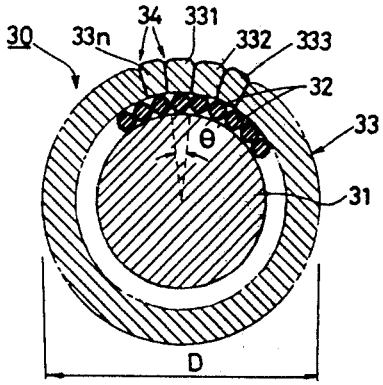
FIG. 4A is a sectional view of a transmission conductor of one embodiment in accordance with the present invention.
Figure 4B:
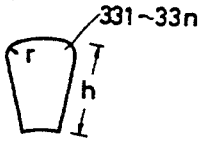
FIG. 4B is an enlarged sectional view of one split conductor element of the outer conductor layer.

FIG. 4A is a sectional view of a transmission conductor in accordance with one embodiment of the present invention and FIG. 4B is an enlarged sectional view of one split conductor element of an outer conductor layer of the FIG. 4A embodiment. Referring to FIGS. 4A and 4B, a transmission conductor 30 comprises inner conductor layers 31 and 32 and an outer conductor layer 33. Although the inner conductor layers 31 are shown in a simplified manner in FIG. 4A, usually the transmission conductor 30 comprises a plurality of layers of inner conductors, each layer including a plurality of a sectional circular conductor elements, as shown in the inner conductor layer 32 in FIG. 4A, which are bundled and stranded. The outer conductor layer 33 is generally annular in section and having an even outer surface, which is radially split into a plurality ($n=360/\theta$) of split conductor elements 33*l* to 33*n*. The split conductor elements are generally referred to as segment conductors. Outer corners of the two adjacent split conductor elements between these plurality of split conductor elements 33*l* to 33*n* are formed in rounded corners, i.e. arcuate in section, with a radius r (m) of curvature. The split conductor elements of such sectional geometry can be fabricated by heating in advance a conductive material of a wire or a rod of such as copper, aluminum, or the like and by drawing the same through a mold having an aperture of the shape as shown in FIG. 4B. The split conductor elements 33*l* to 33*n* are arranged on the outer surface of the bundle of the inner conductors 32 to cover the inner conductor and to form an outer conductor layer, annular in section, and the bundle of conductors thus attained is stranded in the longitudinal direction, thereby to complete the transmission conductor 30 shown in FIG. 4A. It would be appreciated that as a result a plurality of grooves 34 are formed on the outer surface of the transmission conductor 30 extending in the stranded longitudinal direction. Each of the grooves 34 is formed between the outer rounded corners of the arcuate from with the radius r (m) of curvature such that one end of each of the rounded corners connects to the splitting surface of each split conductor element and the other end of each of the rounded corner connects to the outer surface of each split conductor element far from the splitting surface. As a result, the sectional configuration of the groove 34 is bugle shaped. The angle between the two adjacent grooves with respect to the center of the transmission conductor is denoted by the reference character $\theta$.

Figure 5:
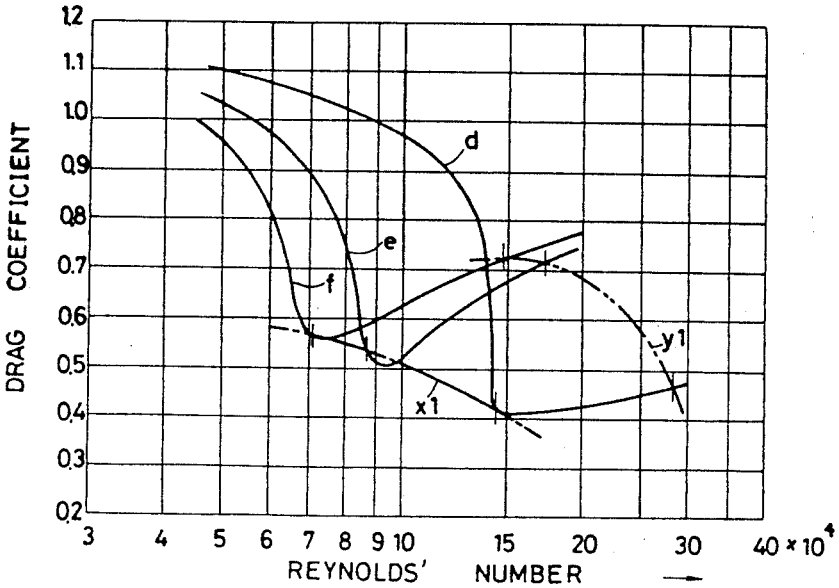
FIG. 5 is a graph showing a relation between the Reynolds' number R and the drag coefficient Cx obtained using prototype samples of the structure shown in FIGS. 4A and 4B, wherein the angle $\theta$ between the two adjacent grooves with respect to the center of the transmission conductor is maintained constant as 12° and the ratio of the radius r of curvature to the diameter D is changed.

FIG. 5 is a graph showing a relation between the Reynolds' number R and the drag coefficient Cx obtained using different plot type samples of the FIG. 4A transmission conductor, wherein the angle $\theta$ between the two adjacent grooves with respect to the center of the transmission conductor is maintained constant as 12° and the ratio of the radius r (m) of curvature to the diameter D (m) of the transmission conductor is changed. Referring to FIG. 5, the abscissa indicates the Reynolds' number R in the logarithmic scale and the ordinate indicates the drag coefficient Cx in the ordinary scale. The characteristic curves d, e, and f shown by the solid lines show the characteristics of the samples, wherein the angle between the two adjacent grooves with respect to the center of the transmission conductor is maintained constant to be 12° ($\theta=12°$) and the ratio r/D of the radius r of curvature to the diameter D is selected to be different. More specifically, the curve d shows the case where the ratio r/D=17.4/1000, the curve e shows the case where the ratio r/D=29.1/1000, and the curve f shows the case where the ratio r/D=34.9/1000.

Meanwhile, generally in calculating a wind pressure of a transmission conductor, the region where a change rate of the drag coefficient Cx is small as compared with a change of a Reynolds' number R is adopted in consideration of a change of the wind velocity. Therefore, in selecting a utilizable range of the curves d, e and f for the different ratios of the radius r of curvature to the diameter D obtained by experimentation, such regions are determined in the following manner. More specifically, first the one dotted line curve x1 connecting the points of the minimum values of the drag coefficient Cx on the curves d, e and f is selected as a region of the minimum value of the Reynolds' number R. On the other hand, the maximum value of the Reynolds' number R is selected to be a range of two times the minimum value of the Reynolds' number R, as well known to those skilled in the art. The range of two times the minimum value of the Reynolds' number R is selected as the maximum number in consideration of the fact that an actual wind velocity could change higher and lower than the wind velocity selected in designing the transmission conductor. Accordingly, the Reynolds' number R adopted in designing a transmission line is selected to be a range from the region of the minimum value shown by the one dotted line curve x1 to the region of the maximum value shown by the two dotted line curve y1. More specifically, the Reynolds' number R is selected to be in an range of R=approximately 7.1 to approximately $28\times10^4$ in the case where the angle between the two adjacent grooves with respect to the center of the transmission conudctor is selected as $\theta=12°$ and the ratio r/D of the radius r of curvature to the diameter D is selected as r/D=17.4/1000 to 34.9/1000.

Figure 1A:
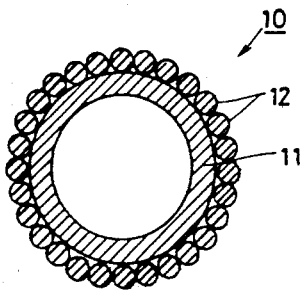
FIG. 1A is a sectional view of a conventional transmission conductor comprising a plurality of conductor elements, each of a circular section, as bundled in a cylindrical form and stranded.

Now the drag coefficient Cx of the inventive transmission conductor of the FIG. 4A embodiment and the drag coefficient Cx of the FIG. 1A conventional transmission conductor are compared for further analysis. For example, in the range of the Reynolds' number R=7.5 to $20\times10^4$, the drag coefficient Cx of the inventive transmission conductor of the FIG. 4A embodiment is such that Cx is 0.4 to 0.6, whereas the drag coefficient Cx of the conventional transmission conductor shown in FIG. 1A is such that Cx=0.9 to 0.95. Accordingly, it would be appreciated that the inventive transmission conductor 30 of the FIG. 4A embodiment has reduced the drag coefficient Cx by 0.3 to 0.55 as compared with that of the FIG. 1A conventional transmission conductor 10, in the range of the Reynolds' number R=7.5 to $20\times10^4$. Thus, it is further appreciated that due to the decreased drag coefficient Cx a wind pressure of the inventive transmission conductor can be reduced in association with the reduced rate of the drag coefficient Cx, whereby a wind pressure reducing effect is achieved by the present invention.

It is presumed that such transmission conductor of a reduced wind pressure, as described above, might be quantitatively defined in terms of a given configuration coefficient, by properly selecting a relation between the ratio r/D of the radius r of curvature to the diameter D and the angle $\theta$ between the two adjacent grooves with respect to the center of the transmission conductor based on the experimentation. Under the circumstances, a possibility of such quantitative representation of a reduced wind pressure transmission conductor in terms of a configuration coefficient is examined.

Figure 6A:
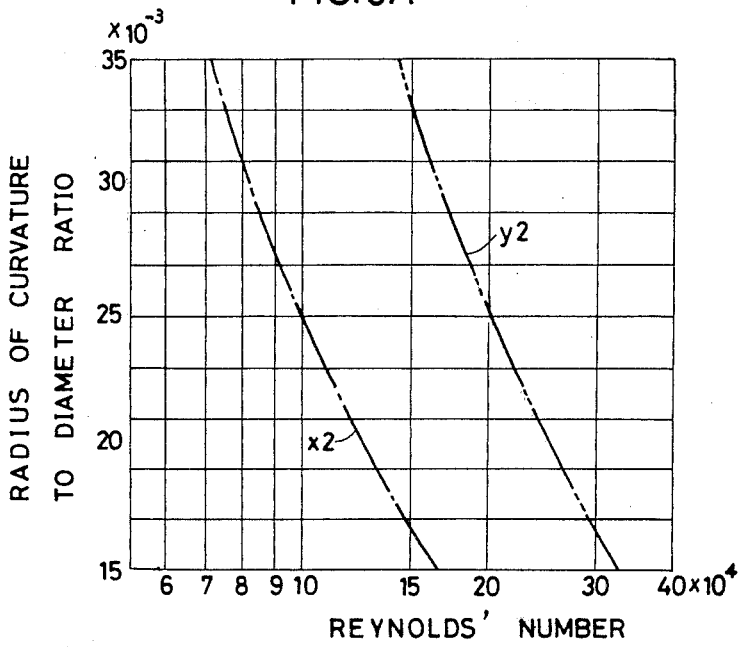
FIG. 6A is a graph showing a relation between the Reynolds' number R and the ratio of the radius r of curvature to the diameter D obtained through conversion from the minimum value shown by the one dotted line curve x1 and the maximum value shown by the two dotted line curve y1 shown in FIG. 5, where the angle $\theta$ between the two adjacent grooves with respect to the center of the transmission conductor is maintained constant as 12°.

FIG. 6A is a graph showing the ratio r/D of the radius r of curvature to the diameter D and the Reynolds' number R obtained through conversion from the minimum values shown by one dotted line curve x1, and the maximum values shown by the two dotted line curve y1 shown in FIG. 5 in the case where the angle $\theta$ between the two adjacent grooves with respect to the center of the transmission conductor is maintained constant as 12°. Referring to FIG. 6A, the abscissa indicates the Reynolds' number R in the logarithmic scale, while the ordinate indicates the ratio r/D of the radius r of curvature to the diameter D in the ordinary scale. The one dotted line curve x2 shown in FIG. 6A is a line connecting the points plotting the ratio r/D with respect to the minimum value of the Reynolds' number R of the respective samples shown by the one dotted line curve x1 in FIG. 5. The two dotted line curve y2 shown in FIG. 6A is a curve connecting the points plotting the ratio r/D with respect to the maximum value of the Reynolds' number R of the respective samples shown by the two dotted line curve y1 in FIG. 5.

Likewise, the inventor of the present application fabricated some samples by changing the angle $\theta$ and by further changing the ratio r/D of the respective samples of the different angle $\theta$ and then investigated a relation between the ratio r/D of the radius r of curvature to the diameter D and the Reynolds' number R based on the data obtained on the experimentation. Then it was observed that the relation thus obtained exhibited the same gradient as that of the one dotted line curve x2 and the two dotted line curve y2 representing the regions of the minimum and maximum values of the Reynolds' number R shown in FIG. 6A and only the values in the abscissa direction were different.

Figure 6B:
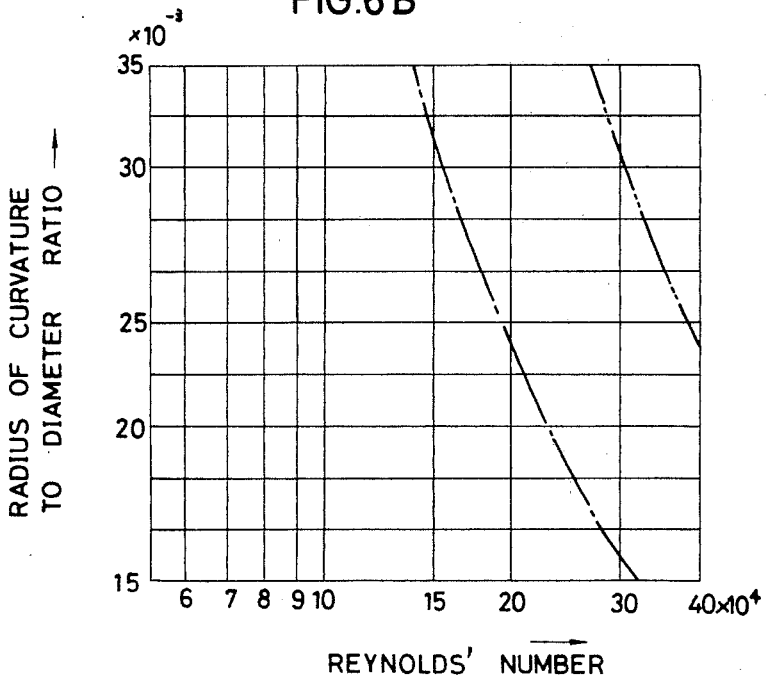
FIG. 6B is a graph similar to that shown in FIG. 6A but shows such relation as that of the FIG. 6A graph in the case where the angle $\theta$ is selected to be 45°.

FIG. 6B is a graph similar to that shown in FIG. 6A but line curve x2 shown in FIG. 6A the relation between the ratio r/D of the radius r of curvature to the diameter D and the Reynolds' number R can be represented by a predetermined relation.

Therefore, a formula was sought and as a result it was further observed that the formula can be expressed as r/D=K1/R, and the constant K1 can be represented by the product of the ratio r/D and the Reynolds' number R. Upon observing the curves d, e and f of the respective samples of the different ratios r/D shown in FIG. 5 in the case where $\theta=12°$, for example, the Reynolds' number R is $14.4\times10^4$ in the case where r/D=17.4/1000, the Reynolds' number R is $8.6\times10^4$ in the case where r/D=29.1/1000, and Reynolds' number R is $7.2\times10^4$ in the case where r/D=34.9/1000, whereby K1=2500 is obtained. Accordingly, a general formula of the curve shown by the one dotted line curve x2 in FIG. 6A is represented by r/D=2500/R. Likewise, the constant K1 of the maximum value shown by the two dotted line curve y1 in FIG. 5 becomes K1=5000. As a result, a general formula of the curve shown by the two dotted line curve y2 in FIG. 6A becomes r/D=5000/R. As a result, it is appreciated that the ratio r/D of the radius r of curvature to the diameter D should be selected such that a relation between the ratio r/D and the Reynolds' number R in the case where the angle $\theta=12°$ may be a range of r/D=2500/R to 5000/R.

Figure 7:
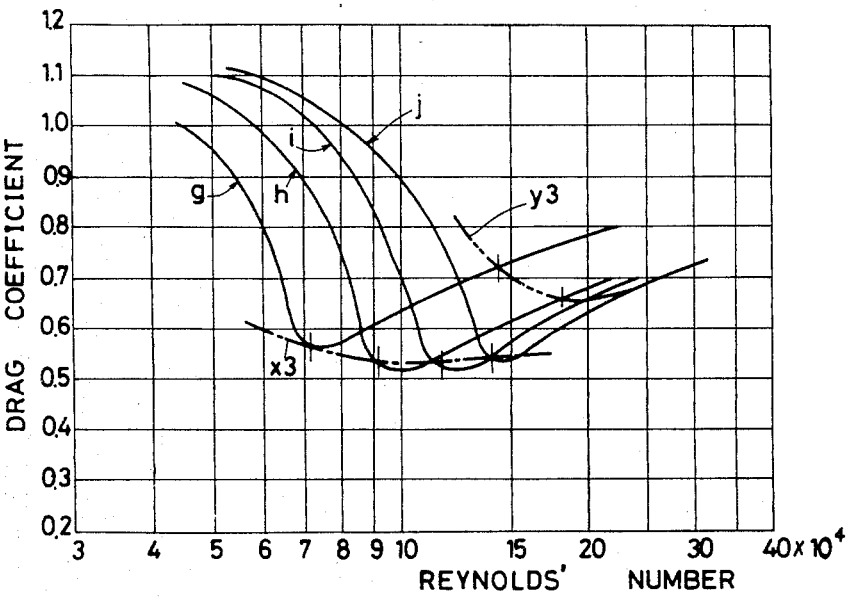
FIG. 7 is a graph showing a relation between the Reynolds' number R and the drag coefficient, wherein the ratio r/D of the radius of curvature to the diameter is maintained constant as R/D=39.9/1000 and the angle $\theta$ between the two adjacent grooves with respect to the center of the transmission conductor is changed in the embodiment shown in FIGS. 4A and 4B.

FIG. 7 is a graph showing the relation between the drag coefficient Cx and the Reynolds' number R of the FIG. 4A transmission conductor in the case where the ratio r/D of the radius r of curvature to the diameter D is maintained constant as r/D=34.9/1000 and the angle $\theta$ between the two adjacent grooves with respect to the center of the transmission conductor is changed. Referring to FIG. 7, the curve g shows a case where the angle $\theta=12°$, the curve h shows a case where the angle $\theta=24°$, the curve i shows a case where the angle $\theta=36°$, and the curve j shows a case where the angle $\theta=45°$. A line connecting the minimum values of the drag coefficients Cx of the respective samples in such case is shown by the one dotted line curve x3. A line connecting the maximum values of the respective samples in this case where the value two times the minimum value of the Reynolds' number R is selected as the maximum value is shown by the two dotted line curve y3.

Figure 8A:
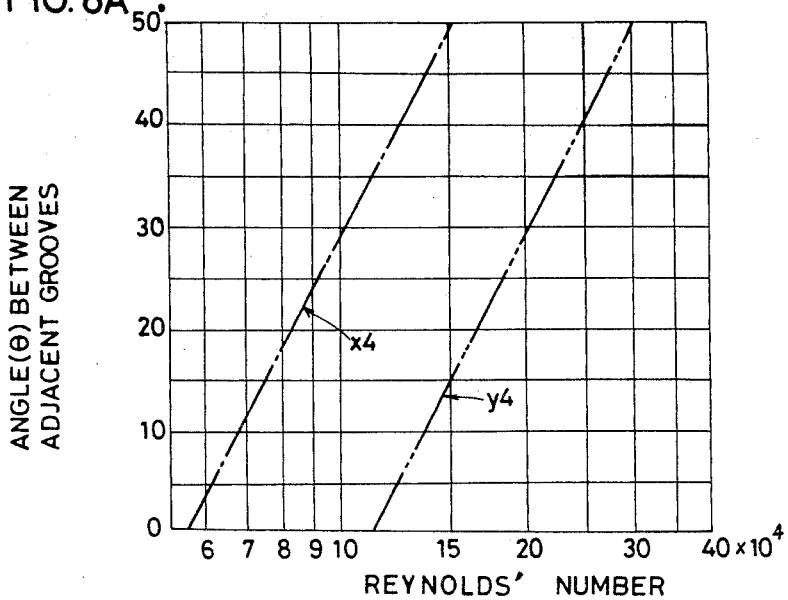
FIG. 8A is a graph showing a relation between the Reynolds' number R and the angle $\theta$ between the two adjacent grooves with respect to the center of the transmission conductor obtained through conversion from the minimum values shown by the one dotted line curve x3 and and maximum values shown by the two dotted line curve y3 in FIG. 7.

FIG. 8A is a graph showing a relation between the angle $\theta$ and the Reynolds' number R obtained through conversion from the minimum values shown by the one dotted line curve x3 and the maximum values shown by the two dotted line curve y3 in FIG. 7. Referring to FIG. 8A, the effectively utilizable range is between the one dotted line x4 and the two dotted line y4. Meanwhile, various experimentation was made using different samples prepared by changing the ratio r/D and as a result it was observed that the relation between the angle $\theta$ and the Reynolds' number R is represented by a linear curve exhibiting the same gradient even in the case where the ratio r/D is changed.

Figure 8B:
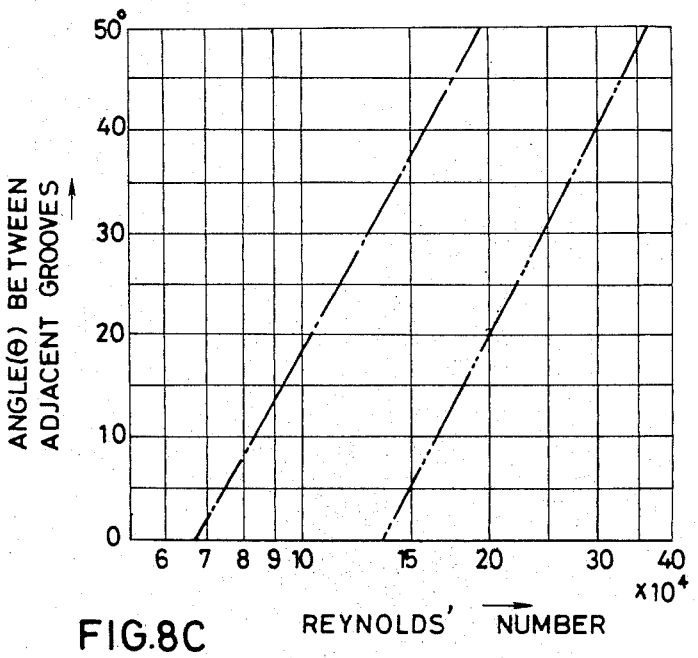
FIGS. 8B and 8C are graphs similar to that shown in FIG. 8A but show such relation as that of the FIG. 8A graph in the case where the ratio r/D is selected to be 29.1/1000 and 45.5/1000, respectively.
Figure 8C:
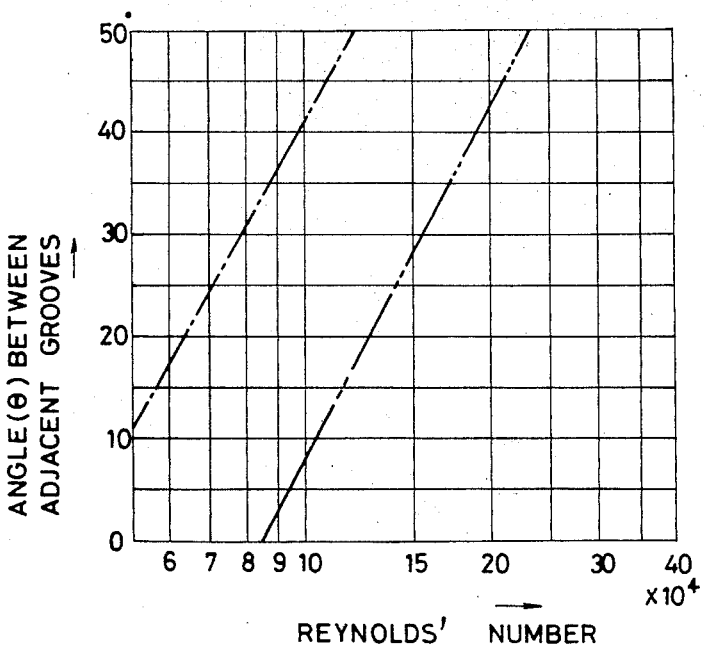

By way of one example, the measured values in the case of r/D=29.1/1000 are shown in FIG. 8B and the measured values in the case of r/D=45.5/1000 are shown in FIG. 8C. It was observed by these graphs that the relation between the angle $\theta$ and the Reynolds' number R can be expressed by a predetermined formula. As one example, by evaluating the relation between the angle $\theta$ and the Reynolds' number R from the gradient of the one dotted line curve x4 in FIG. 8A, the junction of the angle $\theta$ in the case where the Reynolds' number R is selected to be the minimum in FIG. 7 is represented as $\theta=113 \log R\times10^{-5}+28.5$. Furthermore, by evaluating the relation between the angle $\theta$ and the Reynolds' number R from the gradient of the two dotted line curve y4, the function of the angle $\theta$ in the case where the Reynolds' number R is selected to be the maximum is represented as $\theta=113 \log R\times10^{-5}-5.2$.

From the foregoing description in conjunction with the characteristic diagrams, the applicable range of the inventive transmission conductor 30 can be calculated by formulas in the following manner.

First assuming that the angle $\theta$ is maintained constant such that $\theta=12°$, then the optimum range of the Reynolds' number R in the case where the ratio r/D of the radius r of curvature to the diameter D is changed is represented by the following equation (3), as described previously in conjunction with FIG. 6A:

$$\frac{r}{D}=\frac{2500}{R}\sim\frac{5000}{R} \tag{3}$$

By evaluating the radius r of curvature by the equation (3), the radius r is represented by the following equation (4):

$$r=D/R(2500\sim5000) \tag{4}$$

By substituting $R=VD/\nu$ in the equation (4), the radius r is represented by the following equation (5):

$$r=(2500\sim5000)\frac{1.456\times10^{-5}}{V}=\frac{0.0364\sim0.0728}{V} \tag{5}$$

It would be appreciated from the above described equation (5) that the radius r of curvature can be determined only by a wind velocity value to be determined in designing the transmission conductor.

On the other hand, the relation between the optimum angle $\theta$ and the Reynolds' number R in the case where the ratio r/D is maintained constant such that r/D(=34.9/1000) and the angle $\theta$ is changed is represented by the following equation (6), as described previously in conjunction with FIG. 8A:

$$\theta=113 \log R\times10^{-5}+(28.5\sim-5.2) \tag{6}$$

The equation for the Reynolds' number R can be obtained from the equation (6) and may be expressed by the following equation (7):

$$R=10^{\frac{\theta-(28.5\sim-5.2)}{113}}\times10^{5} \tag{7}$$

The optimum conditions of the ratio r/D and the angle $\theta$ can be evaluated as follows based on the above described equations (5) and (7). More specifically, the ratio r/D in the case where the angle $\theta$ is maintained constant is, as is clear from the equation (3), in a reverse proportional relation to the Reynolds' number R. Therefore, assuming that a proportion constant is K1, then the ratio r/D can be expressed by the following equation (8).

$$r/D=K1/R \tag{8}$$

The proportion constant K1 can be obtained by the following equation (9) by substituting R of the equation (7) in the equation (8) based on the result of experimentation of the ratio r/D being 34.9/1000:

$$K1=\frac{34.9}{1000}R=34.9\times10^{-3}\times10^{\frac{\theta-(28.5\sim-5.2)}{113}}\times10^{-5} \tag{9}$$

Accordingly, in the case where the angle $\theta$ is given, the optimum radius r of curvature in the case of the wind velocity V to be determined in designing the transmission conductor is determined by the range shown by the following equation (10).

$$\begin{aligned} r&=\frac{DK1}{R} \\ &=\frac{K1\nu}{V} \\ &=3490\left(10^{\frac{\theta-28.5}{113}}\sim10^{\frac{\theta+5.2}{113}}\right)\times\frac{1.456\times10^{-5}}{V} \\ &=\frac{0.0508}{V}\left(10^{\frac{\theta-28.5}{113}}\sim10^{\frac{\theta+5.2}{113}}\right) \end{aligned} \tag{10}$$

In selecting the radius r of curvature represented by the equation (10), the optimum range of the radius r of curvature can be known by properly selecting the wind velocity to be determined in designing the transmission conductor and the angle $\theta$ between the two adjacent grooves with respect to the center of the transmission conductor.

Thus, it would be appreciated that by forming a plurality of grooves on the outer surface of a transmission conductor in a longitudinal direction so that each groove is defined by the outer rounded corners of the two adjacent split conductor elements to be arcuate in section with the radius r of curvature satifying the above described equation (10), a transmission conductor of a reduced wind pressure can be attained.

Meanwhile the inventive concept can be applied not only to a transmission conductor of a reduced wind pressure but also to a transmission conductor of a reduced wind singing. Therefore, in the following a transmission conductor of a reduced wind singing in accordance with the present invention will be described.

An attempt to achieve a transmission conductor of a reduced wind singing using a transmission conductor 30 of such structure as shown in FIG. 4A was conceived as a result of analysis of the manner of formation of a von Kärmän's votex stream caused by each of a conventional transmission conductor comprising an outer conductor layer of an arrangement of a plurality of conductor elements circular in section which are stranded, and a transmission conductor comprising an outer conductor layer of a pipe having an even outer surface.

Figure 9A:
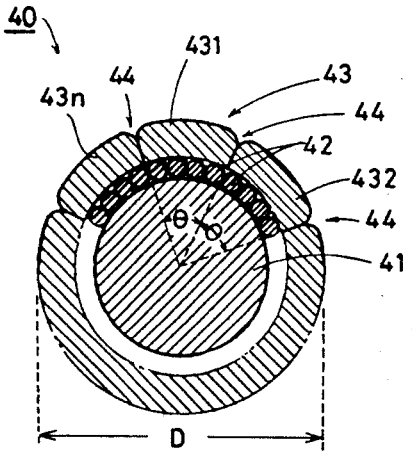
FIG. 9A is a sectional view of a transmission conductor of a reduced wind singing in accordance with another embodiment of the present invention.
Figure 9B:
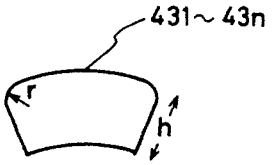
FIG. 9B is an enlarged sectional view of one split conductor element of the outer layer of the FIG. 9A embodiment.

FIG. 9A is a sectional view of a transmission conductor 40 of a reduced wind singing in accordance with another embodiment of the present invention. FIG. 9B is an enlarged sectional view of one split conductor element of the FIG. 9A embodiment. The transmission conductor 40 of the FIG. 9A embodiment is different from the transmission conductor 30 of the FIG. 4A embodiment in the angle $\theta$ and the radius r of curvature are selected to reduce a wind singing in the FIG. 9A embodiment. Since the remaining portions of the FIG. 9A embodiment are substantially the same as those in the FIG. 4A embodiment, similar reference numerals are used to denote like portions except that the numeral 3 is used in the first digit position of the reference numerals in the FIG. 4A embodiment whereas the numeral 4 is used in the first digit position of the reference numerals in the FIG. 9A embodiment. Under the circumstances, a repetition of a detailed description of the same portions will be omitted in conjunction with FIG. 9A.

In order to determine the optimum geometry of the inventive transmission conductor 40 of a reduced wind singing, a relation among the radius r (m) of curvature, the diameter D (m) of the transmission conductor, the angle $\theta$ (degree) between the two adjacent grooves with respect to the center of the transmission conductor, and the difference of the maximum sound pressure level $\Delta L$ (dB) was analized. The difference of the maximum sound pressure level $\Delta L$ (dB) is defined as a difference obtained by subtracting the maximum sound pressure level of the transmission conductor 40 having the same diameter and an improved structure as shown in FIG. 9A from the maximum sound pressure level of a given conventional transmission conductor 10 as shown in FIG. 1A comprising an outer conductor surface of an arrangement of a plurality of conductor elements each circular in section and which are stranded.

In the experimentation a low wind singing tunnel of 80 cm×80 cm was used and the transmission conductor 40 was placed at the position 50 cm away from the exit portion. The experimentation was carried out using two different wind velocities of 15 m/sec and 25 m/sec. The reason of such selection is that with the wind velocity not in excess of 15 m/sec and a wind singing by a transmission conductor becomes little or no problem while with a wind velocity in excess of 35 m/sec a wind singing i.e. a background noise, caused by the circumstances becomes much larger than the wind singing caused by the transmission conductor. Table 1 shows the difference of the maximum sound pressure level $\Delta L$ (dB) for each of different wind velocities in the case where comparison is made between the result of experimentation in which the radius r (m) of curvature, the diameter D (m) and the angle $\theta$ (degree) of the FIG. 4A transmission conductor 40 are properly changed and the result of experimentation in the case where the diameter D (m) is the same.

TABLE 1

| Geometry of Transmission Conductor | | | Difference of Maximum Sound Pressure Level $\Delta L$ (dB) | |
|---|---|---|---|---|
| Diameter D ($\times 10^{-3}$ m) | Angle $\theta$ (degree) | Radius of Curvature r ($\times 10^{-3}$ m) | Wind Velocity 15 m/sec | Wind Velocity 25 m/sec |
| 38.4 | 36 | 2.9 | +7.0 | −2.5 |
| 38.4 | 45 | 2.3 | +9.5 | +2.5 |
| 38.4 | 45 | 3.0 | +6.0 | +2.0 |
| 38.4 | 45 | 4.6 | +3.0 | −3.0 |
| 38.4 | 60 | 4.5 | +1.0 | −6.5 |
| 52.8 | 60 | 4.0 | +3.5 | −6.5 |
| 38.4 | 90 | 5.0 | −1.5 | −7.0 |
| 52.8 | 90 | 5.0 | +1.0 | −3.0 |

TABLE 2

| Geometry of Transmission Conductor | | | Difference of Maximum Sound Pressure Level $\Delta L$ (dB) | | Configuration Coefficient K2 |
|---|---|---|---|---|---|
| Diameter D ($\times 10^{-3}$ m) | Angle $\theta$ (degree) | Radius of Curvature r ($\times 10^{-3}$ m) | Wind Velocity 15 m/sec | Wind Velocity 25 m/sec | |
| 38.4 | 36 | 2.9 | +7.0 | −2.5 | 2.32 |
| 38.4 | 45 | 2.3 | +9.5 | +2.5 | 2.25 |
| 38.4 | 45 | 3.0 | +6.0 | +2.0 | 2.43 |
| 38.4 | 45 | 4.6 | +3.0 | −3.0 | 2.85 |
| 38.4 | 60 | 4.5 | +1.0 | −6.5 | 2.95 |
| 52.8 | 60 | 4.0 | +3.5 | −6.5 | 2.53 |
| 38.4 | 90 | 5.0 | −1.5 | −7.0 | 3.25 |
| 52.8 | 90 | 5.0 | +1.0 | −3.0 | 2.90 |

Figure 10:
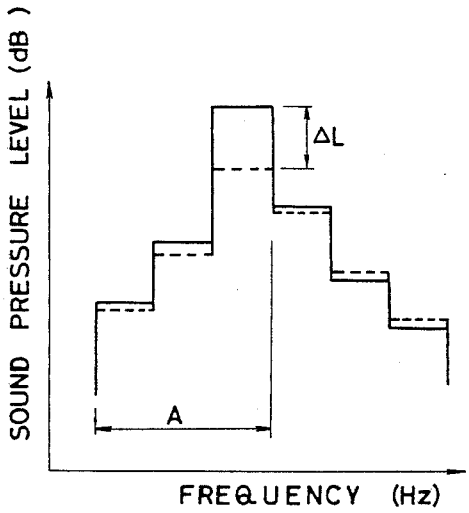
FIG. 10 is a graph showing a characteristic of the sound pressure level for the respective frequency bandwidth with respect to a wind singing of each of the FIG. 1A conventional transmission conductor and the transmission conductor of the FIG. 9A embodiment.

FIG. 10 is a graph showing a characteristic of the sound pressure level for the respective frequency bandwidth with respect to a wind singing of each of the FIG. 1A conventional transmission conductor and the transmission of the FIG. 9A embodiment. Specifically, the solid line curve shows the characteristic of the conventional transmission conductor 10 shown in FIG. 1A and the dotted line shows the characteristic of the transmission conductor of the FIG. 9A embodiment. It is noted that the difference between the sound pressure level of the conventional transmission conductor 10 in the frequency bandwidth where the maximum sound pressure level is reached and the sound pressure level of the transmission conductor of the FIG. 9A embodiment, i.e. the difference of the maximum sound pressure level, is denoted by $\Delta L$.

Referring to Table 1, the case where the difference of the maximum sound pressure level $\Delta L$ (dB) is minus means that the maximum sound pressure level of the transmission conductor 40 of the FIG. 9A embodiment is lower than that of the conventional transmission conductor 10, assuming that both are of the same diameter. Analysis of Table 1 suggests that the diameter D (m) of the transmission conductor and the radius r (m) of curvature have some correlation with reduction of a wind singing. More specifically, it is presumed that the ratio r/D of the radius r (m) of curvature to the diameter D (m) of the transmission conductor has apparently some correlation with the difference of the maximum sound pressure level ΔL. On the other hand, a change of the difference of the maximum sound pressure level ΔL with respect to a change of the angle $\theta$ (degree) is slight as compared with that of the ratio r/D, although it cannot be said that both have no relation. Therefore, it would be considered appropriate to represent a relation between the angle $\theta$ and the difference of the maximum sound pressure level ΔL by indicating the angle $\theta$ (degree) in a logarithmic scale, i.e. in terms of log $\theta$. Based on the above described presumption, it was observed that in expressing the difference of the maximum sound pressure level ΔL in association with the configuration of the transmission conductor, a configuration coefficient K2 of the transmission conductor may be expressed by the following equation (11):

$$K2 = 10\, r/D + \log \theta \qquad (11)$$

By rearranging the data shown in Table 1 in consideration of the above described configuration coefficient, the data shown in Table 2 and the graph shown in FIG. 11 to be described subsequently were obtained.

Figure 11:
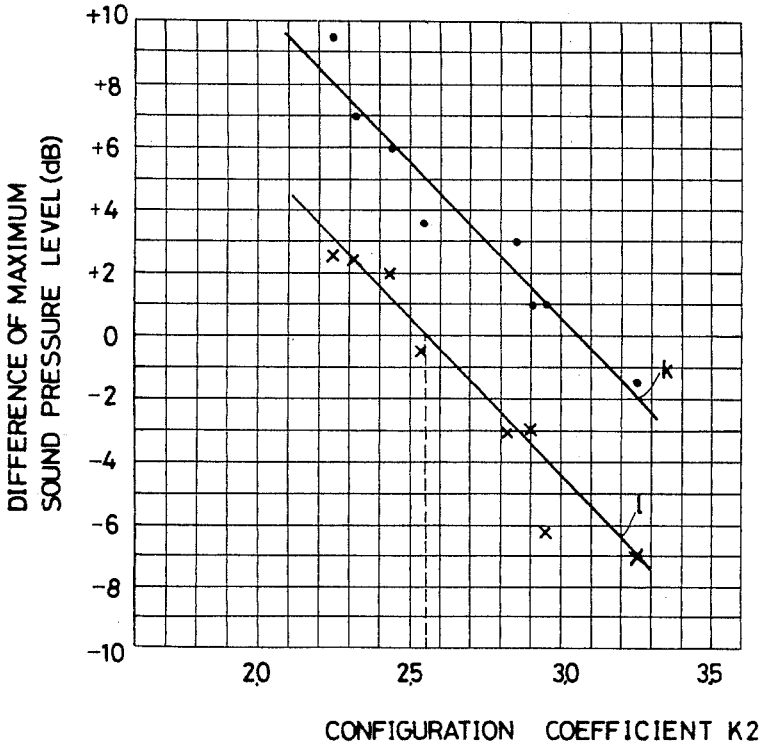
FIG. 11 is a graph showing a relation between a configuration coefficient K2 of the transmission conductor of the FIG. 9A embodiment and the difference of the maximum sound pressure level $\Delta L$ with the wind velocity as a parameter.

FIG. 11 is a graph showing a relation between a configuration coefficient K2 of the transmission conductor of the FIG. 9A embodiment and the difference of the maximum sound pressure level ΔL with the wind velocity as a parameter. Referring to FIG. 11, the solid line K connecting the dot mark shows a relation between the configuration coefficient K2 and the difference of the maximum sound pressure level ΔL in the case where the wind velocity is 15 m/sec and the solid line L connecting the X mark points shows a relation between the configuration coefficient K2 and the difference of the maximum sound pressure level ΔL in the case where the wind velocity is 25 m/sec.

It was confirmed from the FIG. 11 graph that the diameter D (m) of the transmission conductor and the radius r (m) of curvature have exerted an influence upon the difference of the maximum sound pressure level ΔL in terms of the ratio r/D of the radius r of curvature to the diameter D. It was further confirmed that the angle $\theta$ (degree) has exerted an influence upon the difference of the maximum sound pressure level ΔL in terms of log $\theta$. Thus, it was confirmed that, in such a case, an influence of the ratio r/D upon the difference of the maximum sound pressure level ΔL is larger than that of the angle $\theta$ (or log $\theta$) upon the difference of maximum sound pressure level ΔL and, in the case where the configuration coefficient K2 is constant, the larger the wind velocity the lower the difference of the maximum sound pressure level ΔL. Meanwhile, it is pointed out that, unless the difference of the maximum sound pressure level ΔL is minus, no effect of reducing a wind singing is achieved, as is clear from the foregoing description.

In consideration of the FIG. 11 graph based on the above described analysis, it would be appreciated that the configuration coefficient for the respective wind velocities where the difference of the maximum sound pressure level ΔL is smaller than zero, i.e. minus, will bring about an effect of reducing a wind singing in the range of $K2 > 3.05$ for the wind velocity 15 m/sec and in the range of $K2 > 2.55$ for the wind velocity of 25 m/sec. Meanwhile, generally in the region where the wind velocity is low, the value itself of the maximum sound level is lower than the value in the region where the wind velocity is high. In consideration of the foregoing, it was observed that by selecting the configuration coefficient K2 so that the difference of the maximum sound pressure level ΔL at the wind velocity 25 m/sec where a problem of wind singing becomes serious, i.e. by selecting the diameter D (m) of the transmission conductor, the radius r (m) of curvature, and the angle $\theta$ (degree) so that the configuration coefficient K2 may be larger than 2.55, it is possible to reduce the maximum sound pressure level in a region where the wind velocity is relatively high to cause a problem of a wind singing, thereby to achieve the effect of reducing a wind singing.

Meanwhile, by selecting the ratio r/D and the angle $\theta$ (degree) to be larger, it is possible to increase the configuration coefficient K2 and to achieve more effective reduction of a wind singing. However, there is naturally a limit in designing a transmission conductor in conjunction with stranding the split conductor elements regarding the height h of the split conductor elements and the angle $\theta$ (degree), and therefore in actual fabrication of a transmission conductor it is presumed that a general limit would be such that the ratio $r/D \leqq 1/6$ and the angle $\theta \leqq 180°$. However, it is pointed out that the present invention is not limited to the above described values. Assuming that the ratio $r/D = 1/6$ and the angle $\theta = 180°$, then the configuration coefficient $K = 3.92$ and the requirement that the configuration coefficient $K > 2.55$ is satisfied. More specifically, the transmission conductor 40 of the FIG. 9A embodiment can be fully applied in actually designing a transmission conductor, while the above described ranges are fully met.

Figure 12:
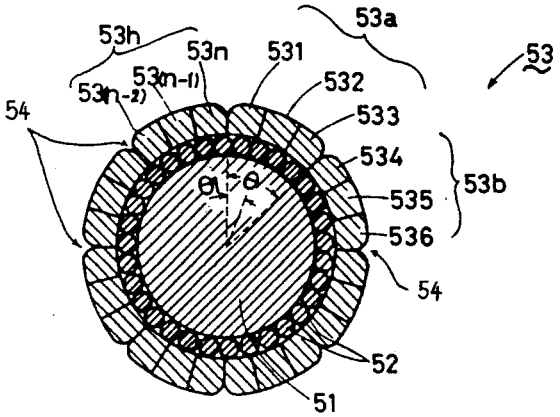
FIG. 12 is a sectional view of a transmission conductor in accordance with still a further embodiment of the present invention.

FIG. 12 is a sectional view of a transmission conductor in accordance with still a further embodiment of the present invention. The FIG. 12 embodiment was developed to eliminate a difficulty which is encountered in stranding the split conductor elements of the outer conductor layer 53 in the case where the angle $\theta$ (degree) exceeds 40° and the width of the split conductor elements becomes large. More specifically, the transmission conductor 50 of the embodiment shown comprises the outer conductor layer 53, annular in section, which is radially split into a plurality of conductor elements, each having a relatively small angle $\theta 1$ between both sides with respect to the center of the transmission conductor, i.e. the angle between both sides of each conductor element with respect to the center of the transmission conductor being smaller than the angle $\theta$ between the two adjacent grooves with respect to the center of the transmission conductor. More specifically, the outer conductor layer is radially split into a plurality ($n = 360/\theta 1$) of the conductor elements and the plurality ($n = 360/\theta 1$) of the split conductor elements are divided into a plurality of groups, each including an integral number ($\theta/\theta 1$) of split conductor elements, while only the outer corners of the two adjacent split conductor elements at both ends of each group are formed in rounded corners to be arcuate in section with the radius r (m) of curvature. In other words, outer corners of the two adjacent split conductor elements at every predetermined number ($\theta/\theta 1$) of the junctions between the plurality of split conductor elements are formed in rounded corners.

In the FIG. 12 embodiment, the angle $\theta$ between the two adjacent grooves with respect to the center of the transmission conductor is selected to be 45° ($\theta=45°$) and the angle between both sides of each conductor element with respect to the center of the transmission conductor is selected to be 15° ($\theta 1=15°$), so that the groups 53*a*, 53*b*, . . . 53*h* are formed for every three of the split conductor elements 531 to 533, 534 to 536 . . . 53(n−2) to 53*n*. It is seen that the corners for the junctions between the middle split conductor elements such as 532, 535, . . . 53(n−1) and the split conductor elements at both sides in the same group such as 531 and 533, 534 and 536 . . . 53(n−2) and 53*n* are not formed in round corners. Instead the outer corners at both sides of group of three split conductor elements, such as the outer corner of the conductors 531 and 533, 534 and 536, . . . 53(n−2) and 53*n* are formed in rounded corners to be arcuate in section with the radius r (m) of curvature. As a result, the number of grooves 54 thus formed is the quotient obtained by dividing the total number of the split conductor elements by the number of split conductor elements in each group.

Since the embodiment shown is structured such that the portion of the outer conductor layer defined by the angle $\theta$ between the two adjacent grooves is divided into a plurality of conductor elements, an advantage is brought about that even if the angle $\theta$ is increased and hence the circumferential directional length of the portion of the outer conductor layer between the two adjacent grooves is increased, a difficulty is not caused in stranding and hence no problem is caused in fabrication of the transmission conductor of the embodiment.

Figure 13:
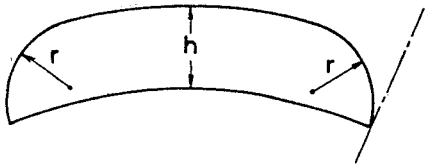
FIG. 13 is a sectional view of another example of the split conductor element, in which the height or thickness of the split conductor elements is selected to be small.

Meanwhile, the FIG. 4A transmission conductor 30 exhibits a conspicuous effect of reducing a wind pressure, whereas the FIG. 9A transmission conductor 40 exhibits a conspicuous effect of reducing a wind singing, as previously described. Nevertheless, since the height of the split conductor elements is restricted in fabrication of such transmission conductors 30 and 40 from the standpoint of strength, it becomes difficult to strand the split conductor elements in the case where the radius r of curvature exceeds a predetermined value. For example, referring to FIG. 13, it could happen that the surface of the rounded corners, arcuate in section, with the radius r of curvature intersects the inner surface of the split conductor element at the side surfaces of the split conductor element if and when the height h of the split conductor elements can not be selected to be much larger than the radius r of curvature, i.e. $h \approx r$. Assuming a case where a plurality of such split conductor elements are arranged to form an outer conductor layer annular in section and stranded, since the two adjacent split conductor elements contact each other in a line contact manner at both sides of each conductor element, it could happen that in stranding the conductor elements one conductor element slides over the rounded arcuate corner of the other split conductor element and for this reason it becomes difficult to accurately strand the split conductor elements. In particular, in the case where the angle $\theta$ is selected to be large, it is necessary to split each split conductor element into a plurality of minor elements. In such a case, since such split minor elements at both sides of each split conductor element each are not of asymmetrical configuration by themselves, force being exerted to them in stranding becomes very unstable and therefore it is more difficult to accurately strand the split conductor elements in such a situation.

Such a problem encountered in the case where the height h of the split conductor elements cannot be selected to be large enough can be avoided by the approach to be described in the following.

Figure 14A:
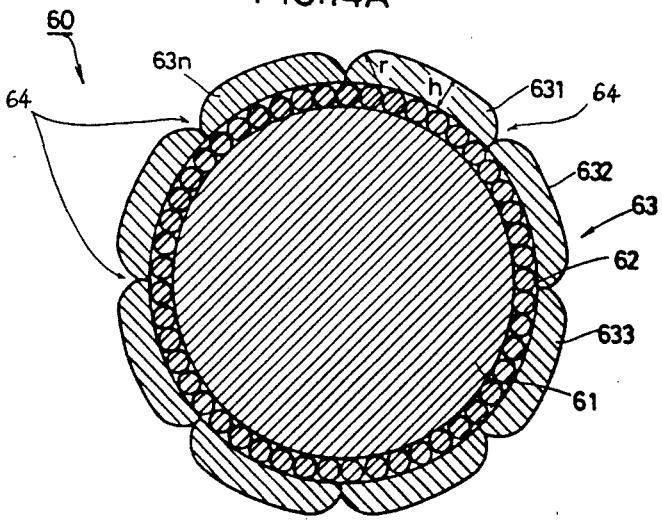
FIG. 14A is a sectional view showing a transmission conductor of still a further embodiment of the present invention.
Figure 14B:
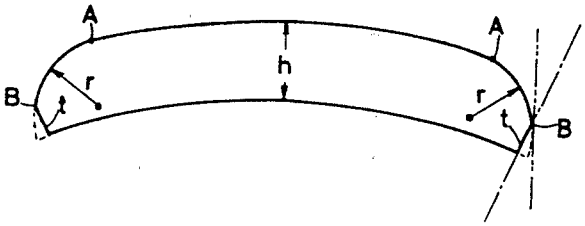
FIG. 14B is an enlarged sectional view of one split conductor element of the outer conductor layer of the FIG. 14A embodiment.
Figure 14C:
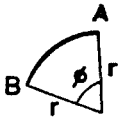
FIG. 14C is a view for explaining selection of the curvature of each of the outer rounded corners of the split conductor elements of the FIG. 14A embodiment.

FIG. 14A is a sectional view of a transmission conductor of still a further embodiment of the present invention. FIG. 14B is an enlarged sectional view of one split conductor element for use in the FIG. 14A embodiment. FIG. 14C is a view for explaining determination of an arcuate portion of the split conductor element. The transmission conductor 60 of the FIG. 14A embodiment comprises inner conductor layers 61 and 62 and an outer conductor layer 63. The inner conductor layers 61 and 62 include a plurality of layers each including a plurality of conductor elements each circular in section, which are stranded in the longitudinal direction. One feature of the embodiment shown resides in the outer conductor layer 63, which comprises a plurality of split conductor elements radially split and having an even outer surface, the conductor elements being stranded in the longitudinal direction. As shown in FIG. 14B, the outer corners at both sides (in the circumferential direction in section) of each of the split conductor elements 63*l* to 63*n* are formed in rounded corners to be arcuate in section with the radius r of curvature. The radius r of curvature is selected to be substantially the same as the height or thickness h of the split conductor elements. Each of the split conductor elements is further shaped such that both end portions are cut in the radial direction of the center of the transmission conductor at the position slightly inward of both side extremities, thereby to leave the contacting surfaces t at both sides. As a result, it follows that the tangential line of the above described rounded corners being arcuate in section with the radius r of curvature at the uppermost position B of the above described contacting surfaces having the height t does not extend on the center of the transmission conductor whereas in the case of the embodiments described previously in conjunction with FIGS. 4A, 9A and 12 such tangential line extends just on the center of the transmission conductor inasmuch as the height or thickness of the split conductor elements was selected to be larger than the radius r of curvature of the rounded corners being arcuate in section. These split conductor elements 63*l* to 63*n* are arranged to form an outer conductor layer on the outer surface of the inner conductor layers 62 formed in a cylindrical shape and are stranded in the longitudinal direction. As a result, a plurality of grooves 64 are formed on the outer surface of the transmission conductor 60, each groove being formed with two arcuate portions of the radius r of curvature in a bugle form in section.

For the purpose of effectively utilizing the above described transmission conductor 60 as a transmission conductor of a reduced wind pressure or a transmission conductor of a reduced wind singing, the inventors of the present application made various experimentation by changing the radius r (m) of curvature, the angle $\theta$ (degree) between the two adjacent grooves with respect to the center of the transmission conductor, the diameter D (m) of the transmission conductor, the wind velocity V (m/sec) and the height t (m) of the contacting surfaces formed by cutting the both sides with a view to finding the optimum conditions for that purpose. As a result, it was confirmed that substantially the same effect as that in the case where the arcuate portion in section is a quarter of the whole circumference of the circle having the radius r can be achieved when the length of the arcuate portion in section for forming the above described grooves 24 is larger than 75/360 of the whole circumference of the circle of the same radius as the radius r of curvature of the above described arcuate portion in section.

Now referring to FIG. 14C, a relation between the arcuate portion in section and the radius r of curvature will be described. Assuming that the arcuate portion in section of the split conductor element is AB and the radius r of curvature of the arcuate portion in section AB is r, the relation between the arcuate portion in section AB and the radius r of curvature is expressed by the following equation (12):

$$\widehat{AB} \geqq \frac{75}{360} \times 2\pi r \qquad (12)$$

$$\geqq \frac{5}{12}\pi r$$

In other words, it was observed that if and when the angle $\phi$ for the arcuate portion $\widehat{AB}$ is larger than 75° substantially the same effect as that in the case where each groove is formed with two arcuate portions each being a quarter of the whole circumference of the circle of the same radius r as that of the radius r of curvature can be achieved with the grooves each being formed with two arcuate portions $\widehat{AB}$.

Accordingly, in practicing the present invention for the purpose of achieving a reduced wind pressure or a reduced wind singing, if and when some restrictions are imposed on design of the inventive transmission conductor so that the height h of the outer conductor layer must be selected to be nearly equal to the radius r of curvature, i.e. $h \approx r$, it is recommended to cut both sides of the split conductor element as shown in FIG. 14B in the above described manner. More specifically, by cutting both sides of the split conductor element in the radial direction of the transmission conductor thereby to form the contacting surfaces having the height h so as to satisfy the above described equation (12) and by forming the grooves 64 with the remaining arcuate portions, the resultant transmission conductor 60 achieves the effect of reducing a wind pressure and a wind singing and assures stable stranding.

The reason why substantially the same effect as that in case of a transmission conductor having grooves formed with two arcuate portions each being a quarter of the whole circumference of the circle of the radius r can be attained by the FIG. 14A embodiment where each groove is formed with two arcuate portions smaller than a quarter of the whole circumference of the circle of the radius r can be presumably explained in the following manner. More specifically, the problems of a wind pressure and a wind singing are primarily caused due to the geometry in the vicinity of both side portions of each groove and no or little flow of air occurs in the deep portion of the grooves due to the wind and even if a little flow of air occurs in the deep portion of groove due to the wind such flow is not large enough to cause a problem of a wind pressure or a wind singing due to separation of the wind.

As a result of experimentation, it has been confirmed that in case of a normal transmission conductor the height t of the contacting surfaces is preferably larger than approximately 1 mm. On the other hand, the height h of the split conductor elements is preferably selected to be smaller than 5 mm in the case of a normal transmission conductor, particularly from the standpoint of strength.

Meanwhile, in actual fabrication of the inventive transmission conductors, it is necessary to determine the above described factors in consideration of the difficulty of attaining an accurate arcuate portion, a difficulty of accurately attaining the intersection of the arcuate portion and the contacting surfaces, and a difficulty of accurately contacting the two adjacent split conductor elements.

Figure 15:
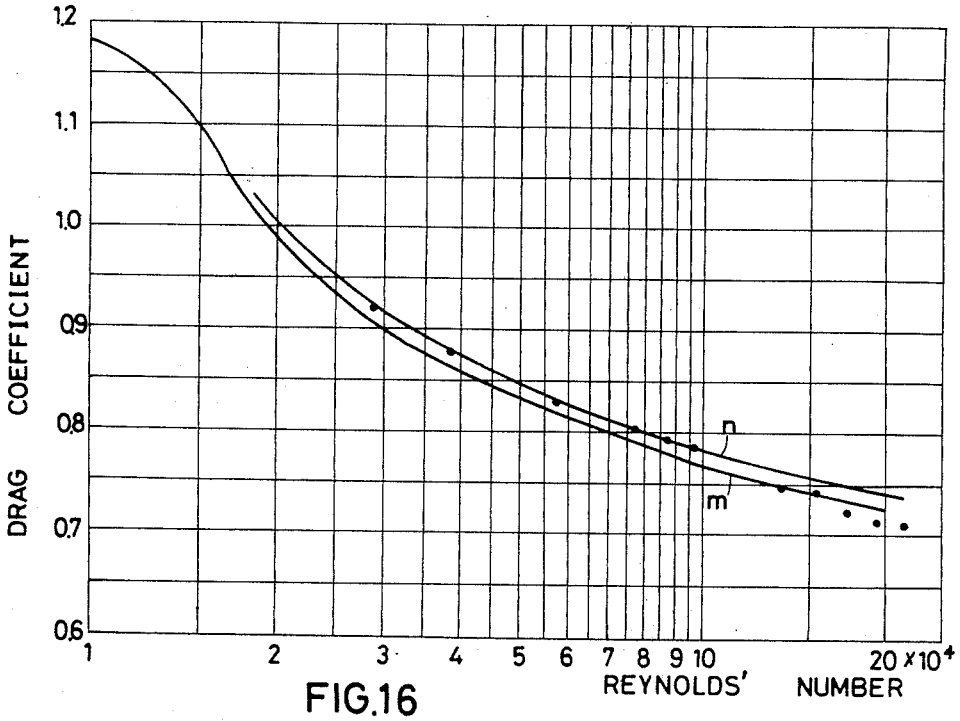
FIG. 15 is a graph showing a wind pressure transmission conductor of the FIG. 14A embodiment.

FIG. 15 is graph showing a comparison between a wind pressure characteristic of one example of the FIG. 14A embodiment and a wind pressure characteristic of a transmission conductor having substantially the same structure as that of the FIG. 14A embodiment except that contacting surfaces of the height t are formed. Various factors of the transmission conductors shown in FIG. 15 were selected as follows:

| | |
|---|---|
| radius of curvature | $r = 5.0 \times 10^{-3}$ m |
| angle | $\theta = 90°$ |
| diameter | $D = 38.4 \times 10^{-3}$ m |
| height of contacting surfaces | $t = 1.2 \times 10^{-3}$ m |
| height of conductor elements | $h = 5.0 \times 10^{-3}$ m |

Referring to FIG. 15, the curve m shows the characteristic of the transmission conductor 60 wherein no contacting surfaces are formed and the curve n shows the characteristic of the transmission conductor where the contacting surfaces are formed. As seen from FIG. 15, even in the case where the contacting surfaces having the height t are formed in the FIG. 14A embodiment substantially the same result is achieved as that in the case where no contacting surfaces t are formed, as far as the characteristic of the drag coefficient Cx with respect to the Reynolds' number R is concerned.

Figure 1B:
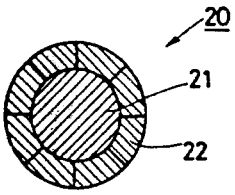
PRIOR ART FIG. 1B
FIG. 1B is a sectional view of another example of a conventional transmission conductor including an outer conductor layer covering an inner conductor and being annular in section and split in a plane or planes radially extending on the center of the transmission conductor into a plurality of split conductor elements.
Figure 2:
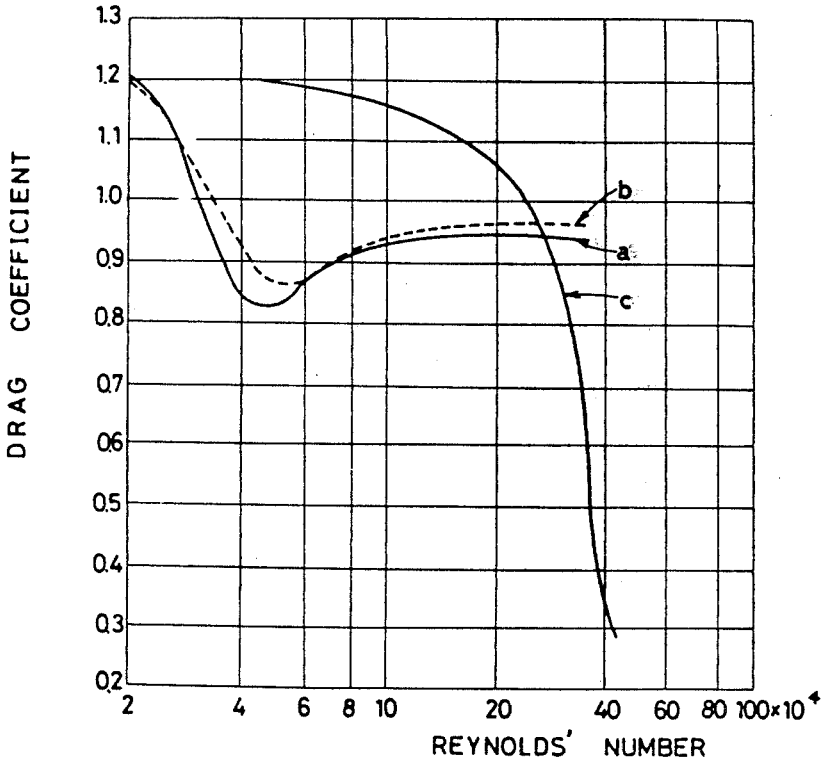
FIG. 2 PRIOR ART
FIG. 2 is a graph showing a relation between the Reynolds' number R and the drag coefficient Cx of a wind receiving surface for each of different kinds of conventional transmission conductors.
Figure 3:
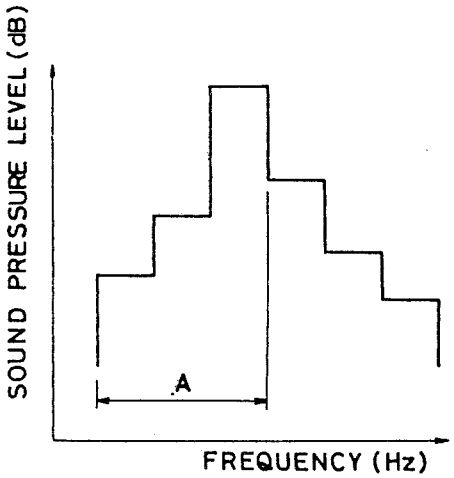
FIG.3 PRIOR ART
FIG. 3 is a graph showing a characteristic of a sound pressure level for the respective frequency bandwidth with respect to a wind singing generated by the FIG. 1A conventional transmission conductor.

Furthermore, since the drag coefficient Cx is 0.74 to 0.81 in the range of the Reynolds' number $R=7.5$ to $20\times10^{-4}$, the drag coefficient Cx can be reduced 0.09 to 0.21 as compared with the same range of the conventional transmission conductor shown in FIG. 1 which is 0.9 to 0.95.

Figure 16:
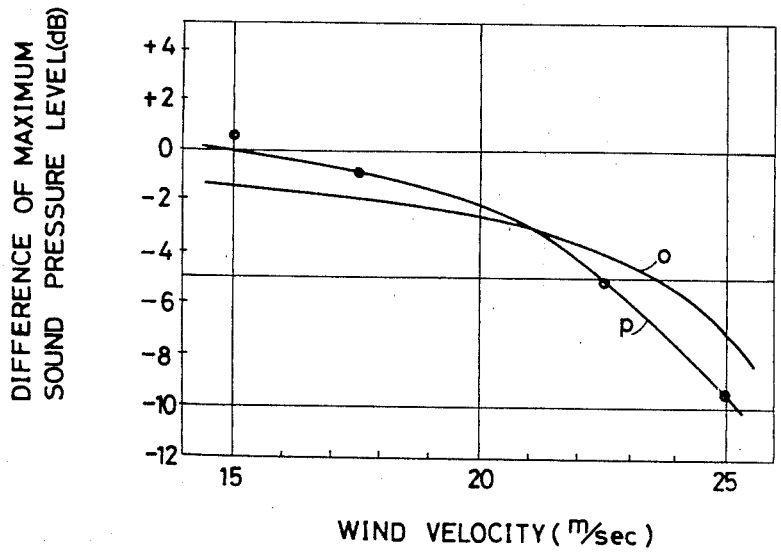
FIG. 16 is a graph showing a wind singing characteristic of the transmission conductor of the FIG. 14A embodiment.

FIG. 16 is a graph showing the result of measurement of the wind singing characteristic made with respect to the same transmission conductors as those of the FIG. 15 wind pressure characteristic. Referring to FIG. 16, the curve o shows the characteristic of the transmission conductor where no contacting surfaces are formed and the curve p shows the characteristic of the transmission conductor where the contacting surfaces are formed. Upon reviewing the FIG. 16 graph, it would be appreciated that the transmission conductor employing the above described conditions exhibit reduction of the difference of the maximum sound pressure level $\Delta L$ as compared with the transmission conductor using the conductor elements of a conventional circular section.

Meanwhile, it is pointed out that two rounded corners, arcuate in section, of the two adjacent split conductor elements may be formed with a continuously changing radius r of curvature, such as a quadratic curve, a cubic curve or any other curve or a combination of a plurality of curves, including the above described curves, insofar as the rounded corners are formed with a radius r of curvature satisfying the equation (10) for the purpose of the inventive reduced wind pressure transmission conductor and with a radius r of curvature making k2 larger than 2.55 in the equation (11) for the purpose of the inventive reduced wind singing transmission conductor.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A transmission conductor, comprising:

an inner conductor formed in a cylindrical shape; and an outer conductor layer covering said inner conductor and being annular in section and having an even outer surface, said outer conductor layer being split in at least one plane extending radially through the center of said transmission conductor into a plurality of split conductor elements, said plurality of split conductor elements being stranded in the longitudinal direction of said transmission conductor, outer corners of the two adjacent split conductor elements at every predetermined number of junctions between said plurality of split conductor elements being formed in rounded corners to be arcuate in section with a radius r (m) of curvature, said radius r (m) of curvature being selected to satisfy the following equation:

$$r = \frac{0.0508}{V}\left(10^{\frac{\theta-28.5}{113}} \sim 10^{\frac{\theta+5.2}{113}}\right)$$

where V (m/sec) is a wind velocity and $\theta$ (degree) is the angle from the groove to the groove, with respect to the center of the transmission conductor, whereby at least one groove is formed on the outer surface of said outer conductor layer extending in the stranded longitudinal direction between said rounded corners of said adjacent split conductor elements.

2. A transmission conductor in accordance with claim 1, wherein the geometry of said groove is selected to satisfy the following formula $$10 \cdot r/D + \log \theta > 2.55$$

where D (m) is the diameter of said transmission conductor.

3. A transmission conductor in accordance with claim 1, wherein each said rounded corner being arcuate in section with said radius r (m) of curvature at the side portion of said split conductor elements is selected such that the tangential line of said rounded corner being arcuate in section at the side edge extends off the center of said transmission conductor, each said split conductor element having said rounded corner is formed to be thick to provide a contacting surface extending from said side edge of said rounded corner in the radial direction to serve as contacting surfaces, and each said rounded corner being arcuate in section is selected to be larger in section than 75/360 of circumference of the circle of the same radius as said radius r (m) of curvature.

4. A transmission conductor in accordance with claim 2, wherein each said rounded corner being arcuate in section with said radius r (m) of curvature at the side portion of said split conductor elements is selected such that the tangential line of said rounded corner being arcuate in section at the side edge extends off the center of said transmission conductor, each said split conductor element having said rounded corner is formed to be thick to provide a contacting surface extending from said side edge of said rounded corner in the radial direction to serve as contacting surfaces, and each said rounded corner being arcuate in section is selected to be larger in section than 75/360 of circumference of the circle of the same radius as said radius r (m) of curvature.

* * * * *

UNITED STATES PATENT AND TRADEMARK OFFICE

CERTIFICATE OF CORRECTION

PATENT NO. : 4,356,346

DATED : OCTOBER 26, 1982

INVENTOR(S) : SADAO SAKABE.

It is certified that error appears in the above-identified patent and that said Letters Patent is hereby corrected as shown below:

Col. 2, line 18, "are" should be --area--;
line 67, after "1A" insert --,--.
Col. 5, line 25, delete "and" (first occurrence).
Col. 6, line 42, "from" should be --form--.
Col. 7, line 34, "an" should be --a--.
Col. 8, line 39, after "but" insert --shows such relation as that of the Fig. 6A graph in the case where the angle $\theta$ is selected to be $45^{\circ}$. Thus it was further observed that by evaluating the gradient of the one dotted--.
Col. 11, line 36, after "in" insert --that--.

Signed and Sealed this

*Twenty-second* Day of *March 1983*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,356,346

DATED : OCTOBER 26, 1982

INVENTOR(S) : SADAO SAKABE.

It is certified that error appears in the above-identified patent and that said Letters Patent is hereby corrected as shown below:

Front page, [30] Foreign Application Priority Data,
after "Sep. 17, 1980 [JP] Japan ..... 55-129605"
insert --Oct. 27, 1980 [JP] Japan ..... 55-151105--.

Signed and Sealed this

*Twenty-third* Day of *August 1983*

[SEAL]

*Attest:*

GERALD J. MOSSINGHOFF

*Attesting Officer*

*Commissioner of Patents and Trademarks*